US012397187B2

(12) United States Patent
Kuczminski et al.

(10) Patent No.: US 12,397,187 B2
(45) Date of Patent: Aug. 26, 2025

(54) BARBELL BAR

(71) Applicants: Daniel Kuczminski, Frankfurt am Main (DE); Patrick Blümli, Schöneck (DE)

(72) Inventors: Daniel Kuczminski, Frankfurt am Main (DE); Patrick Blümli, Schöneck (DE)

(73) Assignee: Squeezebar USA LLC, Santa Monica, CA (US)

( * ) Notice: Subject to any disclaimer, the term of this patent is extended or adjusted under 35 U.S.C. 154(b) by 41 days.

(21) Appl. No.: 18/039,409

(22) PCT Filed: Nov. 30, 2021

(86) PCT No.: PCT/EP2021/083666

§ 371 (c)(1),
(2) Date: May 30, 2023

(87) PCT Pub. No.: WO2022/112618

PCT Pub. Date: Jun. 2, 2022

(65) Prior Publication Data

US 2024/0226639 A1 Jul. 11, 2024

(30) Foreign Application Priority Data

Nov. 30, 2020 (DE) ..... 102020131744.1

(51) Int. Cl.
*A63B 21/072* (2006.01)

(52) U.S. Cl.
CPC ..... *A63B 21/0724* (2013.01); *A63B 2210/50* (2013.01)

(58) Field of Classification Search
CPC ..... A63B 21/072; A63B 21/0724; A63B 2210/50
See application file for complete search history.

(56) References Cited

U.S. PATENT DOCUMENTS 4,695,049 A * 9/1987 Ciemiega ..... A63B 23/14 482/46
4,978,122 A * 12/1990 Dibowski ..... A63B 21/0724 482/106
5,152,731 A * 10/1992 Troutman ..... A63B 21/0724 482/106

(Continued)

FOREIGN PATENT DOCUMENTS

DE 202007010986 U1 11/2007
DE 102013001602 A1 7/2014
DE 202017001475 U1 5/2017

*Primary Examiner* — Joshua Lee
(74) *Attorney, Agent, or Firm* — Dykema Gossett PLLC

(57) ABSTRACT

The present invention relates to a barbell bar, which extends along a longitudinal axis of the barbell bar, for training different muscle groups of a person. The barbell bar has the following features: two barbell plate supports which are located on the ends of the barbell bar lying opposite each other on the longitudinal axis and which are configured so as to be able to receive weights, in particular in the form of barbell plates. The barbell bar according to the invention additionally has two grip elements which are located within the two barbell plate supports on the longitudinal axis and which are configured to be used as grips by the person using the barbell bar, wherein the grip elements are arranged on the barbell bar in an at least translationally movable manner along the longitudinal axis.

9 Claims, 2 Drawing Sheets

(56) References Cited

U.S. PATENT DOCUMENTS

| | | | | |
|---|---|---|---|---|
| 7,086,999 | B2 * | 8/2006 | Jeneve | A63B 21/015 482/141 |
| 9,375,601 | B2 * | 6/2016 | Miller | A63B 21/0724 |
| 9,522,298 | B2 * | 12/2016 | Siemer | A63B 21/023 |
| 9,636,534 | B2 * | 5/2017 | Yang | A63B 21/4035 |
| 9,889,329 | B2 * | 2/2018 | Ernst | A63B 21/0724 |
| 11,633,658 | B2 * | 4/2023 | Raber | A63B 21/0724 482/106 |
| 2006/0276314 | A1 * | 12/2006 | Wilson | A63B 21/015 482/106 |
| 2012/0322630 | A1 * | 12/2012 | Hood | A63B 23/16 482/106 |
| 2014/0274595 | A1 | 9/2014 | Patti | |
| 2017/0216654 | A1 | 8/2017 | Parker et al. | |
| 2017/0319894 | A1 * | 11/2017 | Ernst | A63B 21/0728 |
| 2018/0236299 | A1 * | 8/2018 | Warriner | A63B 21/4035 |

* cited by examiner

BARBELL BAR

CROSS-REFERENCE TO RELATED APPLICATION

This application is a national stage filing based upon International application No. PCT/EP2021/083666, filed 30 Nov. 2021, which claims the benefit of priority to Germany application No. 102020131744.1, filed 30 Nov. 2020.

BRIEF SUMMARY

The invention relates to a hand weight bar, in particular a barbell bar, for targeted training of different muscle groups of a user.

Hand weights in various forms for specifically training individual muscle groups of an athlete are known from the field of sports and exercise. One of the most common forms is the barbell, which is typically used for exercises such as bench press, deadlift, squats or the like.

BACKGROUND

A barbell is composed of a barbell bar and weights (barbell plates) of different heaviness, which are pushed onto barbell plate supports and fastened by means of a fixing element such as a clip or the like. In this context, the barbell plates are circular plates having a hole at their centers, wherein the cross-section of the hole corresponds to the cross-section of the barbell plate supports and is slightly larger than the latter so the barbell plates can be fit onto the barbell plate supports. Using the variably attachable weights, the barbell may be adapted to the individual needs of the person in training (athlete) as well as to the different exercises.

The barbell plate supports are each located at the outer ends of the bar. Furthermore, the barbell bar has two sections for better gripping of the barbell by the person in training. For this purpose, these grip sections are usually scarified to improve the grip between the hand and the barbell bar and to reduce the risk of slipping.

SUMMARY OF THE INVENTION

The object of the present invention is to optimize such a barbell bar so that training efficiency using the barbell bar may be further increased for the respective athlete, and consequently individual muscle groups may be trained even more targeted and better.

This object is achieved by the barbell bar according to the invention as defined in the main claim.

A barbell bar according to the invention for training different muscle groups of an athlete extends along a longitudinal axis. It has two barbell plate supports and two grip elements.

The barbell plate supports are arranged on the ends of the barbell bar lying opposite each other on the longitudinal axis and are configured to be able to receive weights, in particular in the form of barbell plates. The grip elements are configured to be used as grips by the person in training (user) and are both located within the barbell plate supports of the barbell bar.

In this context, the grip elements are arranged on the barbell bar in an at least translationally movable manner along the longitudinal axis so the athlete may translate the grip elements along the longitudinal axis even during use, if desired.

Due to the translational movement of the grip elements on the barbell bar, the athlete can bring together the grip elements towards the center of the barbell bar during lifting of the barbell, for example during bench pressing, thus triggering maximum contraction of the target muscle (for example chest muscles) and consequently guaranteeing a more efficient training than with conventional barbells.

In an advantageous embodiment of the invention, the grip elements enclose the barbell bar in its entirety as sleeves and/or sockets. For example, this applies when the grip elements are substantially designed as a hollow cylinder and the internal hole of the grip elements has a slightly larger cross-section than the barbell bar, which is circular as well. The advantage here is that the grip element may be grasped by the athlete in a convenient manner and that is has higher stability due to the closed geometry compared to a solution utilizing non-closed geometry, for example having an opening along the hollow cylinder.

In another advantageous embodiment of the invention, the barbell bar is divided into two regions. They both extend from the center of the barbell bar along the longitudinal axis to the respective opposite ends of the barbell bar, that is, each towards the barbell plate supports located there, and have counter-rotating threads. A grip element is arranged in each of the regions. The grip elements may be moved between the griping elements and the thread along the longitudinal axis of the barbell bar via a corresponding support.

This embodiment has the advantage that it is a robust as well as an easy-to-manufacture and thus a cheap design for implementing the feasibility of translational movement of the grip elements on the barbell bar. The robustness of the barbell bar is particularly relevant when high weights are used in training and consequently the stress on the barbell bar increases.

This embodiment is particularly advantageous when both threads extend symmetrically to one another, that is, they have the same thread pitch. The advantage here is that the movement of the two grip elements is synchronized and thus balanced stress acts on the muscle groups of the athlete. This embodiment is described in more detail in the enclosed drawings.

Furthermore, this embodiment is advantageous when the counter-rotating threads are arranged on the barbell bar as external threads. In this way, a cheap and robust implementation of a barbell bar according to the invention can be accomplished due to the simple execution of the arrangement on the barbell bar.

In another advantageous embodiment of the invention, the two barbell plate supports are supported on the barbell bar such that it allows a rotation of the barbell plates attached to the barbell plate supports around the longitudinal axis of the barbell bar. The support may be accomplished by means of ball bearings or pin bearings, for example.

In some exercises using the barbell, the barbell bar needs to be turned by the athlete so that it rotates around its own longitudinal axis. Here, the placement of the barbell bar support has the advantage that the weight of the barbell plates is not coupled to the rotation of the barbell bar and thus the athlete does not have to rotate the entire weight of the barbell plates together with the barbell bar when turning it. In this way, the wrists may be subjected to a lower amount of stress. In embodiments where, for a translational movement of the grip elements, the remainder of the barbell bar rotates, the placement of the barbell plate supports on the barbell bar may facilitate the movement of the grip elements (see designs in FIGS. 1 and 2.)

In another embodiment of the invention, the barbell bar has at least one linear guide provided to allow the translational movement of the grip elements on the barbell bar along the longitudinal axis. In this way, a constructionally simple and cheap solution for moving the grip elements may be implemented.

In another advantageous embodiment of the invention, the barbell bar consists of at least two structurally separable parts. Here, these parts are configured such that they may be firmly connected to one another in order to obtain the barbell bar. The connection may be secured via a threaded bolt, for example, which may be screwed into female threads in each of the at least two parts. In this case, the female thread is located at the end of the part of the barbell bar where it is to be connected to another part of the barbell bar. This embodiment has the advantage that, in this manner, the barbell bar is easy to disassemble and transport is simplified.

In another embodiment of the invention, the barbell bar has at least one elastic element, which is intended to act on the translational movement of the grip elements along the barbell bar. In this context, the elastic element may be formed as a rubber or spring element, which is arranged between the grip elements and a different part of the barbell bar such that the movement of the grip elements towards the center of the barbell bar is made harder and the movements towards the ends of the barbell bar is made easier in order to allow an even more specific training of the muscle groups. Providing the elastic element between the two grip elements is conceivable as well.

In another advantageous embodiment of the invention, the grip elements have at least one fixing element, which is intended to fix them in at least one specified position along the longitudinal axis on the barbell bar in order to prevent movement in the translation direction at least temporarily. In this way, the barbell may temporarily be transformed into a conventional barbell with rigid, non-movable grip elements when this is advantageous for a certain exercise. In this context, the fixing element may be designed as a bolt, for example, which is inserted into dedicated openings in the thread of the barbell bar and consequently fixes the position of the grip elements on the barbell bar.

As long as multiple fixing means are provided along the barbell bar in order to fix the grip elements in different positions, it is possible to adjust the distances between the individual grip elements and thus adapt the barbell to different bodily prerequisites such as the length of the arms of the athlete.

In another advantageous embodiment of the invention, desired maximum positions of the grip elements may be defined by at least one limiting element so that the grip elements may not be moved beyond the limiting element translationally along the longitudinal axis on the barbell bar.

This embodiment has the advantage that by means of a limiting element a maximum and a minimum distance between the grip elements may be defined. The closer the grip elements are brought together, the harder it is for the athlete to maintain the balance of the barbell. In contrast, too large a distance between the grip elements might result in a situation where the athlete can no longer bring up the strength for holding the barbell. Thus, the limiting element may ensure that a minimum distance and/or a maximum distance of the grip elements is maintained in order to simplify use and prevent instability of the barbell and consequently increase safety, in particular for inexperienced athletes.

This embodiment is particularly advantageous when the limiting element may be attached and removed in different positions on the barbell bar and/or may be adjusted to different positions. In this way, the barbell bar may be adapted to the needs of the individual athletes and/or the respective exercises in a targeted manner. The limiting element may be implemented in the form of a bolt, for example, which may be inserted into a dedicated opening in the thread of the barbell bar.

BRIEF DESCRIPTION OF THE DRAWINGS

The invention is explained in more detail by means of the figures below, wherein individually.

DETAILED DESCRIPTION

Figure 1:
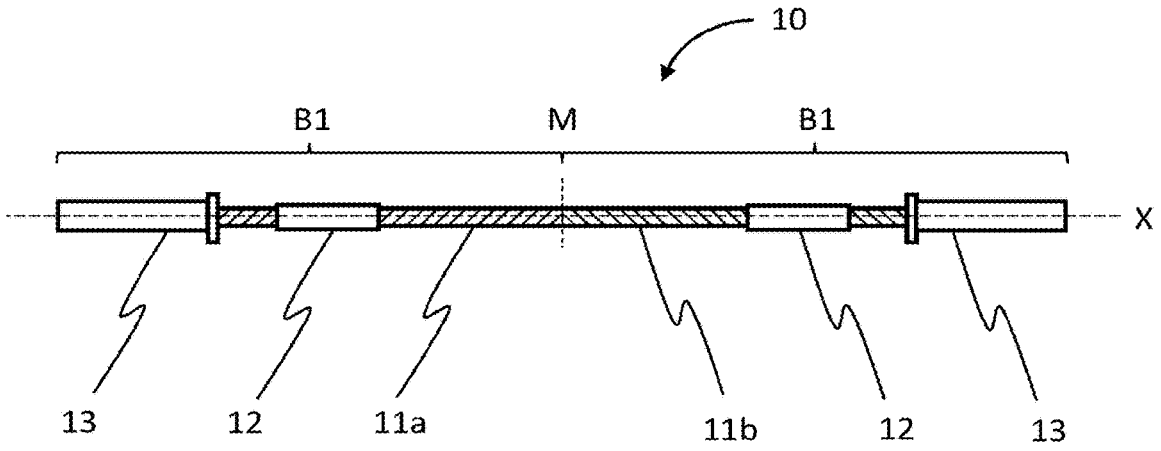
FIG. 1 shows an embodiment of a barbell bar according to the invention in a first position.

FIG. 1 shows an embodiment of a barbell bar 10 according to the invention having a longitudinal axis X. The barbell bar has two grip elements 12 as well as two barbell plate supports 13, wherein weights in the form of barbell plates (not illustrated) are attached to the barbell plate supports 13 and may be fastened by means of a fastening element such as a clip. The barbell plate supports 13 are located on both ends of the barbell bar and are rotationally supported around the longitudinal axis X of the barbell bar 10 by means of pin bearings. In other embodiments, other means of support are also conceivable, of course.

The barbell bar 10 is divided into two regions B1 and B2 of equal length via a center M so that the barbell bar 10 is symmetrical with respect to the center M. The two regions B1 and B2 each have external threads 11*a* and 11*b* on the barbell bar, with the two threads 11*a* and 11*b* being counter-rotating and having the same thread pitch. In this embodiment, a counter-clockwise thread 11*a* is arranged on the one region B1 and a clockwise thread 11*b* is arranged on the region B2. In this context, the threads 11*a* and 11*b* each extend from the center M towards the respective barbell plate supports 13 and terminate there.

The two grip elements 12 are substantially designed as hollow cylinders and enclose the barbell bar 10 in its entirety, wherein one respective grip element 12 is arranged in each of the regions B1 and B2 between the center M and the corresponding barbell plate support 13. Between the insides of the grip elements 12 and the threads 11*a* and 11*b*, balls are arranged, which are guided within the thread profiles of the threads 11*a* and 11*b*. By means of the ball bearing for the grip elements 12 thus created, they may be moved translationally along the longitudinal axis X according to the principle of a recirculating ball screw.

Due to the identical thread pitch of the two counter-rotating threads 11*a* and 11*b*, a synchronized movement of the two grip elements 12 may be guaranteed as long as rotation around the longitudinal axis X is prevented for both grip elements 12, for example by fastening. The translational movement of the grip elements 12 with simultaneous prevention of the rotation of the grip elements 12 makes the barbell bar 10 itself rotate.

Figure 2:
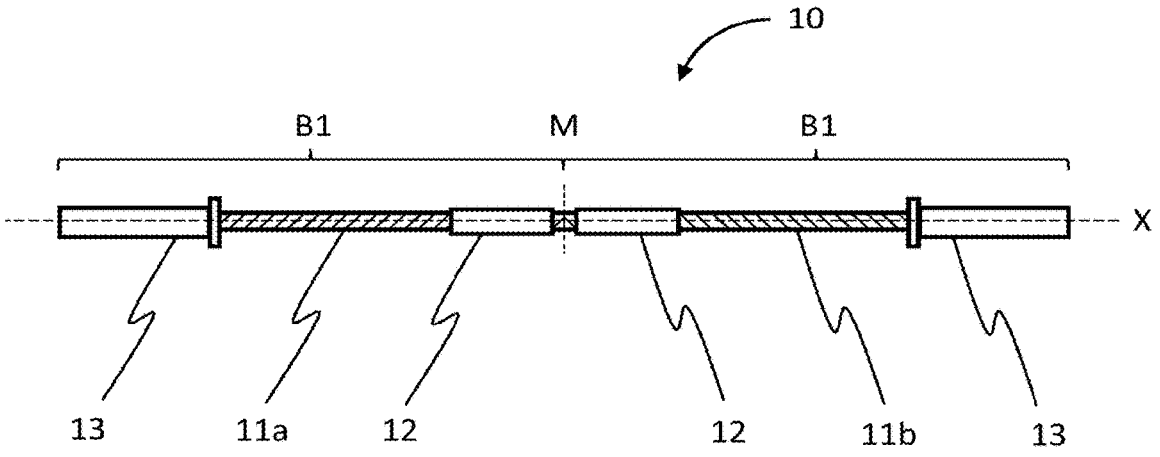
FIG. 2 shows an embodiment of the barbell bar according to the invention in a second position.

FIG. 1 shows an embodiment of the barbell according to the invention where the distance between the grip elements 12 is large. FIG. 2, on the other hand, shows the same embodiment, but with a smaller distance between the grip elements 12.

Next, the functional principle of training with the barbell according to the invention is described in more detail, using the "bench press" exercise as an example.

During bench pressing, the athlete lies on their back on a flat bench, with the barbell including weights located at the height of their chest, that is, above them. Here, the grip elements 12 are in the position shown in FIG. 1 corresponding to the starting position. Next, the athlete pushes the barbell upwards and, at the same time, moves the grip elements 12 towards the center M of the barbell bar 10, thus contracting several muscle groups, in particular arm and chest muscles. By moving the grip elements 12 towards the center M and thus towards the position of the grip elements 12 shown in FIG. 2, the barbell bar is put into rotation via the ball bearings and the respective threads 11*a* and 11*b*. Here, the athlete only needs to put into rotation the weight of the barbell bar without the grips and the barbell plate supports 13 or even the weights located thereon since the barbell plate supports 13 are supported on the barbell bar 10, as described above. Due to the favorable area movement of inertia of the barbell bar for rotation around the barbell bar 10, the strength requirement for rotating the barbell bar and thus for moving the grip elements 12 is comparably low.

Due to the upward movement of the barbell as well as the movement of the grip elements 12 towards the center of the barbell bar, a maximum contraction of the target muscle (for example chest muscle) is triggered and, as a consequence, the training effect is increased. When lowering the barbell, the athlete returns the grips to the starting position (FIG. 1) and continues repeating the exercise.

Figure 3:
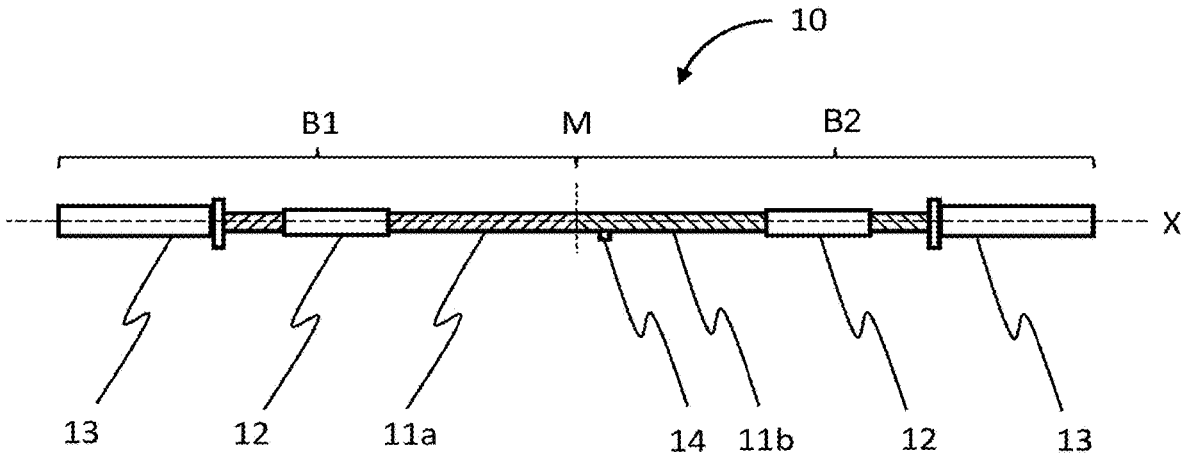
FIG. 3 shows a second embodiment of a barbell bar according to the invention in a first position.

FIG. 3 shows an embodiment of the invention where a limiting element 14 is provided. Apart from this, this embodiment is exactly the same as the embodiment shown in FIGS. 1 and 2, so only the feature of the limiting element 14 is discussed here.

In the present embodiment, the limiting element 14 is designed as a bolt, which may be inserted into a dedicated opening in the barbell bar 10. In this case, the limiting element 14 protrudes from the barbell bar 10 to such an extent that the grip element 12 cannot be moved beyond the limiting element 14, which thus limits the translational movement of the grip element 12 in one direction.

Due to the synchronized movement of the grip elements 12 during use of the barbell bar 10 according to the invention in the present embodiment of FIG. 3, it is sufficient to provide the limiting element 14 on only one side, that is, in a region B1 or B2, in order to cause a limiting effect for the other grip element 12 as well. Furthermore, other embodiments where multiple limiting elements 14, for example for limiting the movement of the grip elements 12 towards the barbell plate supports 13, are conceivable. Similarly, multiple openings for receiving the limiting element 14 may be provided along the barbell bar 10 in order to vary the limits according to the exercise and the body condition of the athlete.

LIST OF REFERENCES

10 barbell bar
11 thread
11*a* (counter-clockwise) thread
11*b* (clockwise) thread
12 grip elements
13 barbell plate support
14 limiting element
X longitudinal axis of barbell bar
M center
B1 first region
B2 second region

The invention claimed is:

1. A barbell bar, which extends along a longitudinal axis of the barbell bar, for training different muscle groups of a user, comprising:

two barbell plate supports, which are located on a first and second end of the barbell bar lying opposite each other on the longitudinal axis and are configured to be able to receive weights in the form of barbell plates; and at least two grip elements, which are located on the longitudinal axis between the two barbell plate supports and are configured to be used as grips by the user, wherein:

the at least two grip elements are arranged on the barbell bar in at least a translationally movable manner along the longitudinal axis during use of the barbell bar;

the barbell bar is divided into two regions via a center, the two regions each extending from the center of the barbell bar along the longitudinal axis towards the respective opposite barbell plate supports, and the two regions each having counter rotating threads extending symmetrically to one another, which are configured to allow the translationally movable manner of the at least two grip elements along the longitudinal axis of the barbell bar; and a plurality of balls are disposed between insides of the at least two grip elements and the counter-rotating threads, the plurality of balls being guided within thread profiles of the counter-rotating threads, and wherein the plurality of balls may be moved with the at least two grip elements translationally about the longitudinal axis according to the principle of a recirculating ball screw.

2. The barbell bar according to claim 1, wherein the at least two grip elements are disposed about the barbell bar as sleeves.

3. The barbell bar according to claim 1, wherein the counter-rotating threads are arranged on the barbell bar as external threads.

4. The barbell bar according to claim 1, wherein the two barbell plate supports are supported on the barbell bar and are rotationally supported around the longitudinal axis of the barbell bar.

5. The barbell bar according to claim 1, wherein at least one linear guide is provided in the barbell bar, the at least one linear guide configured to allow for the translationally movable manner of the at least two grip elements on the barbell bar along the longitudinal axis.

6. The barbell bar according to any claim 1, wherein the barbell bar consists of at least two parts, which are configured to be connected to one another.

7. The barbell bar according to claim 1, wherein the barbell bar has at least one elastic element, which is configured to act on the translationally movable manner of the at least two grip elements along the barbell bar.

8. The barbell bar according to claim 1, wherein the at least two grip elements have a fixing element, which is configured to fix the at least two grip elements in a specified position on the barbell bar.

9. The barbell bar according to claim 1, wherein the barbell bar has at least one limiting element, which is configured to limit the translationally movable manner of the at least two grip elements along the longitudinal axis of the barbell bar and to be positioned at different positions on the barbell bar.

* * * * *